United States Patent [19]

Friebe

[11] Patent Number: 4,629,399

[45] Date of Patent: Dec. 16, 1986

[54] AGGREGATE FOR DELIVERING FUEL FROM A FUEL SUPPLY TANK TO AN INTERNAL COMBUSTION ENGINE OF A MOTOR VEHICLE

[75] Inventor: Karl-Heinz Friebe, Schwieberdingen, Fed. Rep. of Germany

[73] Assignee: Robert Bosch GmbH, Stuttgart, Fed. Rep. of Germany

[21] Appl. No.: 692,925

[22] Filed: Jan. 17, 1985

[30] Foreign Application Priority Data

Oct. 9, 1984 [DE] Fed. Rep. of Germany ..... 3437021

[51] Int. Cl.[4] ..... F04C 2/26; F04C 11/00

[52] U.S. Cl. ..... 417/201; 417/205; 417/247; 418/171

[58] Field of Search ..... 417/201, 244, 247, 205; 418/166, 171, 102, 61 B

[56] References Cited

U.S. PATENT DOCUMENTS

| | | | |
|---|---|---|---|
| 1,968,113 | 7/1934 | Weaver | 418/171 X |
| 2,189,976 | 2/1940 | de Lavand | 418/171 |
| 4,264,288 | 4/1981 | Wusthof et al. | 418/61 B |
| 4,449,891 | 5/1984 | Kemmer | 415/213 T X |
| 4,462,761 | 7/1984 | Ringwald | 415/213 T X |

FOREIGN PATENT DOCUMENTS

| | | | |
|---|---|---|---|
| 88513 | 2/1960 | Denmark | 417/201 |

OTHER PUBLICATIONS 2 sheets of information on the "Gerotor Pump", mentioned on p. 10 of the specification.

*Primary Examiner*—Carlton R. Croyle
*Assistant Examiner*—Theodore Olds
*Attorney, Agent, or Firm*—Michael J. Striker

[57] ABSTRACT

An aggregate for delivering fuel from a fuel supply tank to an internal combustion engine of a motor vehicle comprises an electric drive motor, on the output shaft of which an inner rotor, having teeth on the peripheral surface, is positioned, and a ring-shaped outer rotor surrounding the inner rotor and having inner teeth meshing with the teeth of the inner rotor to form a gear pump. Fuel-conveying vanes are provided on at least one rotor to form a regenerative-type pump. The regenerative-type pump is connected in series to the gear pump as seen in the direction of the fuel supply.

12 Claims, 3 Drawing Figures

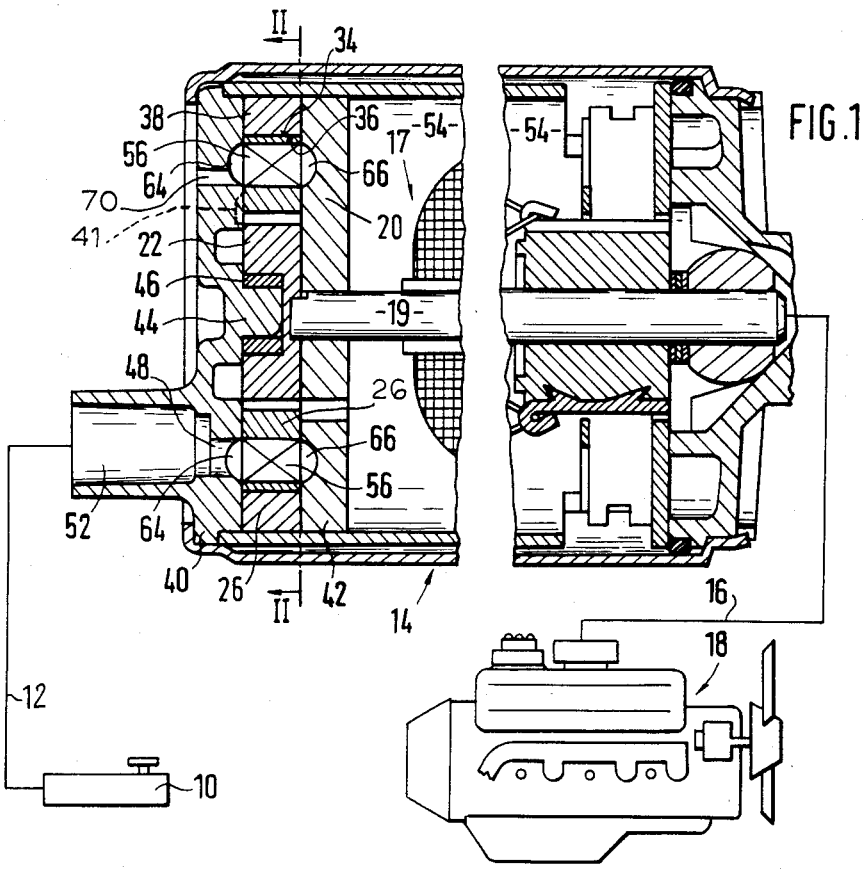
FIG.1
FIG.2
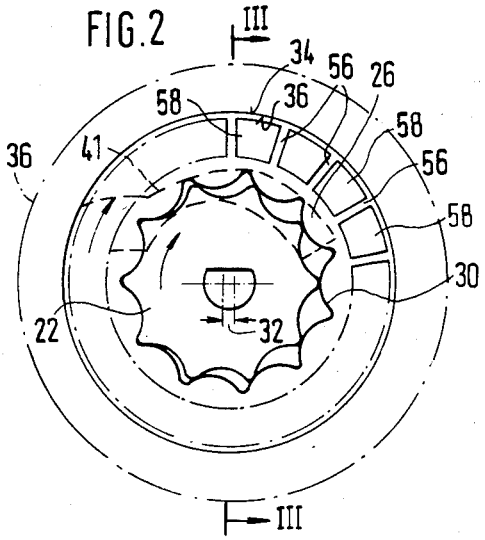
FIG.3
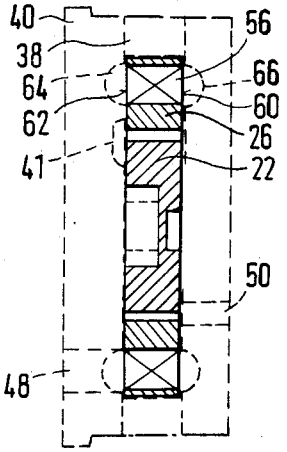

AGGREGATE FOR DELIVERING FUEL FROM A FUEL SUPPLY TANK TO AN INTERNAL COMBUSTION ENGINE OF A MOTOR VEHICLE

BACKGROUND OF THE INVENTION

The present invention relates to an aggregate for delivering fuel from a fuel supply tank to an internal combustion engine of a motor vehicle.

Fuel-delivery aggregates of the type under discussion have been known. DE-OS No. 3,327,453 discloses a fuel supply aggregate in which a one-stage feeding pump is a gear pump (geromotor pump). Particularly during the fuel delivery of heated fuels (hot benzene problems can occur in the suction region of the pump, which would reduce pressure of the fluid in this region. This results in the formation of damping blows (cavitation), which in extreme cases can lead to the fact that the pump would not suck a sufficient amount of fuel or would be totally idle. This can also cause the danger of an improper vehicle operation. It has been found out that this problem is even worse, and practically un-controllable, with positive displacement pumps, and therefore the positive displacement pumps have been coupled to vented regenerative-type pumps. The so-arranged positive displacement pump has been fed with degassed fuel so that the problem of shielding has no longer occurred. A further advantage of such an arrangement resides in that operation noises have been reduced also in the case of higher temperatures and higher suction speeds because no cavitation has taken place in the pump chamber of the positive displacement pump. At the same time common wear is reduced by cavitation.

SUMMARY OF THE INVENTION

It is an object of the present invention to provide an improved aggregate for delivering fluid medium, particularly fuel, from a fuel supply tank to an internal combustion engine of a motor vehicle.

This and other objects of this invention are attained by an aggregate for delivering fluid medium, particularly fuel, from a fuel supply tank to an internal combustion engine of a motor vehicle, comprising a drive motor having a shaft; and a gear pump and including a disk-shaped inner rotor mounted on said shaft and having a peripheral surface formed with a first toothing and a ring-shaped outer rotor surrounding said inner rotor and having a recess formed with a second toothing which is in mesh with said first toothing and a regenerative-type pump provided with fuel-conveying member forming said regenerative-type pump being coupled to said gear pump portion as seen in a direction of fuel delivery.

The outer rotor may be provided with said fuel conveying members.

The fuel conveying members may be vane-shaped and open in a direction of axes of rotation of said inner and outer rotor, said fuel-conveying members being arranged in a wreath.

The aggregate may further include two end plates, said rotors each having opposite end faces, each of said end plates being formed at a wall thereof,extended transversely to said axes of rotation,with a groove-shaped passage cooperating with sai fuel-conveying members.

The wreath of said fuel-conveying members may be formed only on one of said faces.

Both rotors may be positioned between said end plates, said end plates being parallel to each other, and two wreaths of the conveying members may be provided on said outer rotor, each cooperating with a respective groove-shaped passage.

The groove-shaped passages of said two end plates may be positioned opposite to each other.

At least one of the end plates may be formed at said wall with a groove-shaped overflow passage which connects a pressure region of the regenerative-type pump portion with a suction region of the gear pump.

The outer rotor may be formed with a plurality of axisparallel perforations separated from each other by cross-pieces, said cross-pieces forming said fuel-conveying members.

The end plates may limit, in the direction of the axes of rotation of said rotors, a substantially cylindrical chamber, the device may further include an intermediate plate positioned between said end plates and having a recess forming said chamber, said rotors being positioned in said chamber, a fuel inlet opening may be formed in one of said end plates, which opens into said chamber and a fuel outlet opening may be formed in another of said end plates, which also opens into said chamber.

The main advantage of the fuel delivery aggregate of the present invention resides in that, due to the arrangement of the vane-like fuel conveying members, forming a preliminary conveying stage, for example by the outer rotor of the positive displacement pump, a specifically simple and compact construction of the two-stage pump unit is obtained, the preliminary conveying stage of which enables a problemless degassing of the fuel. It is not important how the conveying members of the regenerative-type pump are formed. Any suitable arangement and the shape of these members can be used, as disclosed, for example in U.S. Pat. Nos. 2,696,789; 3,259,072; 3,315,607; 3,995,537 or in German Pat. No. 1,031,641.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWINGS

FIG. 1 is a principle representation, partially in section of a fuel supply system for a vehicle;

FIG. 2 is a sectional view taken along line II—II of FIG. 1 and illustrating the structural components of the gear pump portion of the system of FIG. 1, cooperating with each other via toothings; and FIG. 3 is a sectional view taken along line III—III of FIG. 2.

DETAILED DESCRIPTION OF THE PREFERRED EMBODIMENT

Referring now to the drawings in detail, reference numeral 10 in FIG. 1 designates a fuel supply tank which is connected with the suction side of a fuel supply aggregate 14 via a suction conduit 12. A pressure conduit 16, which leads to an internal combustion engine 18, is connected with a pressure side of the fuel supply aggregate 14. During the operation of the internal combustion engine the fuel supply aggregate 14 delivers fuel from supply tank 10 to the internal combustion engine 18.

The fuel supply aggregate 14 includes an electric drive motor 17, an armature shaft 19 of which is connected to a feeding pump 20 of aggregate 14. For this purpose the end of the armature shaft 19 is connected to an inner rotor 22 for joint rotation. The inner rotor 22 is a component of the gear pump formed as a gerotor pump. The inner rotor 22 is discshaped and has on its peripheral surface an outer toothing 24 seen from FIG. 2. The inner rotor 22 is surrounded by a ring-shaped outer rotor 26. The latter has, at the inner recess thereof, an inner toothing 30 which is in engagement with the outer toothing 24 of inner rotor 22.

With reference to FIG. 2 it will be seen that inner rotor 22 has by one tooth less than the outer rotor 26. The measurable distance 32 forms an excentricity,by which the axis of rotation of the inner rotor is offset relative to the axis of rotation of the outer rotor. The outer rotor 26 has a cylindrical peripheral surface 34 which is fittingly guided in the inner recess 36 which is formed in an intermediate plate 38. The intermediate plate is positioned between two end plates or caps 40 and 42 which limit, in the axial direction of the armature shaft 19, a chamber, which is formed by recess 36 in the intermediate plate 38. The inner and outer rotors 22 and 26 run in this chamber. The end plate 42 is penetrated by the end portion of the armature shaft 19. A bearing pin 44 is formed on the end plate 40. The inner rotor 22 is rotationally supported on pin 44 by means of a slide bearing or sleeve 46. The end plate 40 is provided with a suction opening 48 whereas the end plate 42 has a pressure-side opening 50. The suction opening 48 is connected with the suction conduit 12 via a suction connection 52. The pressure opening 50 opens into a chamber 54, in which the drive motor 17 of the fuel supply aggregate 14 is accomodated. Chamber 54 is in a direct communication with the pressure conduit 16 which leads to the internal combustion engine 18.

As further seen in the drawings, fuel-conveying members 56 are arranged on the outer rotor 26. The fuel-conveying members 56 are formed by cross-pieces or webs which are provided between adjacent perforations or openings 58 formed in the outer rotor 26. The perforations 58 are arranged at least substantially parallel to the axis of rotation of shaft 19 or to the axes of rotation of the inner and outer rotor. Cross-pieces or webs 56, remaining between the openings 58, are located on a common impeller circle so that a wreath-shaped arrangement of vane-like conveying members 56 results. Since the openings 58 open at the both end faces 60 and 62 (FIG. 3) of the outer rotor 26 a so-called open construction of the fuel-conveying impeller results, which has two wreaths of the fuel conveying members of the fluid pump formed as a regenerative-type pump. Each of the two wreaths of the fuel conveying members is respectively formed on each of the two end faces 60, 62 as seen in the direction of the rotation axes of rotors 22, 26. Groove-shaped side channels or passages 64 and 66, which cooperate with the fuel-conveying members 56, are formed,respectively,in the end plates 40 and 42. As seen in FIGS. 1 and 3 in particular, side passages 64 and 66 are positioned opposite to each other and open towards "the wreath" of the fuel-conveying members 53 in the outer rotor 26. A groove-shaped overflow passage 41, which connects the pressure region of the side passage pump 56,64,66 with the suction region of the gear pump 22, 26 is formed in the end plate 40.

When the fuel supply aggregate 14 is in operation the pump arrangement 20 is driven by electric motor 16. Thereby the regenerative-type pump 56, 64, 66, operetting as a preliminary fuel supply stage, sucks the fuel from the supply tank 10 via the suction conduit 12 and the suction opening 48. The conveying pressure increases in the regenerative-type pump, the operation of which is known and describe, for example in U.S. Pat. No. 4,462,761, whereby certain underpressure develops in the suction region of the pump. Damping blows, occurring due to underpressure, are eliminated from the suction region of the regenerative-type pump in the known fashion. The elimination of clamping blows is described for example in U.S. Pat. No. 4,205,947. With the aid of the overflow passage 41 at least substantially gas-free fuel is allowed, to flow into the gear pump-(gerotor pump) 22, 26, wherein the conveying pressure is further increased unless the fuel at a desired conveying pressure is fed through the pressure opening 50 into the chamber 54, and from there into the pressure conduit 18, through which it is delivered to the internal combustion engine 18. A venting bore 70 is provided in the end plate 40. Such venting means is disclosed in the aforementioned patent.

It will be understood that each of the elements described above, or two or more together, may also find a useful application in other types of aggregates for feeding fuel from fuel supply tanks to internal combustion engines of motor vehicles differing from the types described above.

While the invention has been illustrated and described as embodied in an aggregate for feeding fuel from a fuel supply tank to an internal combustion engine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An aggregate for delivering fluid medium, particularly fuel, from a fuel supply tank to an internal combustion engine of a motor vehicle, comprising a drive motor having a shaft; a fuel inlet opening and a fuel outlet opening; and fuel-pump means including a gear pump having an inlet and including a disc-shaped inner rotor mounted on said shaft and having a peripheral surface formed with a first toothing and a ring-shaped outer rotor surrounding said inner rotor and having a recess formed with a second toothing which is in mesh with said first toothing, and a regenerative-type pump formed by a plurality of fuel conveying members provided on at least one of said rotors of said gear pump, said fuel inlet opening being directed to said one of said rotors upstream of the inlet of said gear pump, said regenerative-type pump being coupled to said gear pump as seen in a direction of fuel delivery such that fuel from said regenerative type pump is delivered to said gear Pump whereby a compact two-stage pump is formed.

2. The aggregate as defined in claim 1, wherein said outer rotor is provided with said fuel-conveying members.

3. The aggregate as defined in claim 2, wherein said fuel-conveying members are vane-shaped and open in a direction of axes of rotation of said inner and outer rotor, said fuel-conveying members being arranged in a wreath.

4. The aggregate as defined in claim 3, further including two end plates, said rotors each having opposite end faces, each of said end plates being formed, at a wall thereof extended transversely to said axes of rotation, with a groove-shaped passage cooperating with said fuel-conveying members.

5. The aggregate as defined in claim 4, wherein the wreath of said fuel-conveying members is formed only on one of said faces.

6. The aggregate as defined in claim 4, wherein both rotors are positioned between said end plates, said end plates being parallel to each other, and wherein two wreaths of the conveying members are provided on said outer rotor, each cooperating with a respective groove-shaped passage.

7. The aggregate as defined in claim 6, wherein the groove-shaped passages of said two end plates are positioned opposite to each other.

8. The aggregate as defined in claim 1, further including two end plates each having a wall extended transversely of a direction of axes of rotation of said inner and outer rotor, at least one of said end plates being formed at said wall with a groove-shaped overflow passage which connects a pressure region of the regenerative-type pump with a suction region of the gear pump.

9. The aggregate as defined in claim 7 wherein said outer rotor is formed with a plurality of axis-parallel perforations separated from each other by cross-pieces, said cross-pieces forming said fuel-conveying members.

10. The aggregate as defined in claim 7, wherein said end plates limit, in the direction of the axes of rotation of said rotors, a substantially cyclindrical chamber; and further including an intermediate plate positioned between said end plates and having a recess forming said chamber, said rotors being positioned in said chamber; said fuel inlet opening being formed in one of said end plates and opens into said chamber, said fuel outlet opening being formed in another of said end plates and also opening into said chamber.

11. An aggregate for delivering fluid medium, particularly fuel, from a fuel supply tank to an internal combustion engine of a motor vehicle, comprising a drive motor having a shaft; a fuel inlet opening and a fuel outlet opening; and fuel-pump means including a gear pump having an inlet and including a disc-shaped inner rotor mounted on said shaft and having a peripheral surface formed with a first toothing and a ring-shaped outer rotor surrounding said inner rotor and having a recess formed with a second toothing which is in mesh with said first toothing, and a regenerative-type pump formed by a plurality of fuel conveying members provided on said outer rotor, said fuel inlet opening being directed to said outer rotor upstream of the inlet of said gear pump, said regenerative-type pump being coupled to said gear pump as seen in a direction of fuel delivery such that fuel from said regenerative type pump is delivered to said gear pump whereby a compact two-stage pump is formed.

12. An aggregate for delivery fluid medium, particularly fuel, from a fuel supply tank to an internal combustion engine of a motor vehicle, comprising a drive motor having a shaft;

fuel-pump means including a gear pump including a disc-shaped inner rotor mounted on said shaft and having a peripheral surface formed with a first toothing and a ring-shaped outer rotor surrounding said inner rotor and having a recess formed with a second toothing which is in mesh with said first toothing, and a regenerative-type pump formed by a plurality of fuel conveying members provided on at least one of said rotors of said gear pump, said regenerative-type pump being coupled to said gear pump as seen in a direction of fuel delivery; and two end plates each having a wall extended transversely of a direction of axes of rotation of said inner and outer rotor, at least one of said end plates being formed at said wall with a groove-shaped overflow passage which connects a pressure region of the regenerative-type Pump with a suction region of the gear pump such that fuel from said regenerative-type pump is delivered to said gear pump whereby a compact two-stage pump is formed.

* * * * *